367-93 $$$ SR
E245L XR 4,023,156

United States Patent [19]
Galvin
[11] 4,023,156
[45] May 10, 1977

[54] ALARM SYSTEM FOR DETECTING DISTURBANCE OF A SOLID MEDIUM

[75] Inventor: Aaron A. Galvin, Lexington, Mass.
[73] Assignee: American District Telegraph Company, New York, N.Y.

[22] Filed: Jan. 30, 1975
[21] Appl. No.: 545,388
[52] U.S. Cl. ..... 340/274 R; 340/261; 340/409
[51] Int. Cl.[2] ..... G08B 13/22; G08B 13/08
[58] Field of Search ..... 340/274 R, 261, 409, 340/258 A, 258 C, 258 D; 343/7.7, 5 PD

[56] References Cited

UNITED STATES PATENTS

| | | | |
|---|---|---|---|
| 2,477,567 | 8/1949 | Barker | 340/258 A |
| 2,935,728 | 5/1960 | Morgan | 340/258 A |
| 3,487,396 | 12/1969 | Perelman | 340/261 |
| 3,760,400 | 9/1973 | Galvin et al. | 340/258 A |
| 3,845,461 | 10/1974 | Foreman | 340/258 A |
| 3,863,240 | 1/1975 | Galvin | 343/7.7 |
| 3,889,250 | 6/1975 | Solomon | 340/274 |
| 3,946,377 | 3/1976 | Zetting | 340/274 R |

*Primary Examiner*—Glen R. Swann, III
*Attorney, Agent, or Firm*—Weingarten, Maxham & Schurgin

[57] ABSTRACT

A window pane or other acoustically propagative medium is excited with a source of sonic or ultrasonic energy by use of a suitable transducer affixed to the pane and the amplitude and/or phase of the resulting pattern is sensed and processed to derive a signal repesentative thereof. Violation of the integrity of the pane such as by cutting or breakage thereof or disturbance of the pane such as touching or leaning on the pane causes a sensible change in the pattern and from which is derived an output signal for signifying an alarm condition when the change exceeds a predetermined threshold level.

5 Claims, 6 Drawing Figures

ALARM SYSTEM FOR DETECTING DISTURBANCE OF A SOLID MEDIUM

FIELD OF THE INVENTION

This invention relates to alarm systems which utilize acoustic energy and more particularly to a system which protects a solid medium from breakage or other disturbance by use of a sensible pattern established in the medium.

BACKGROUND OF THE INVENTION

The window alarm is one well-known form of perimeter alarm and employs a thin metal foil strip cemented around the periphery of a window pane such that breakage of the pane causes breakage of the foil and interruption of electrical current which is caused to flow through the foil to thereby cause alarm actuation. Although this relatively simple configuration generally is quite effective, installation costs are quite high as are subsequent maintenance costs occasioned by damage to the foil such as by window cleaning or by inadvertent rubbing against the glass. Moreover, an alarm condition can be avoided by cutting through the protected glass without disturbance of the area containing the foil.

Another known form of window breakage detector employs a passive sensor affixed to a window surface and which senses vibration, shock or high frequency sound which can occur upon breakage of the protected window. In such passive systems, the nature and characteristics of a sensible signal produced upon window breakage cannot always be foreseen. As a result, such passive systems do not usually exhibit good alarm sensitivity and reliability for many commercially realistic installations.

SUMMARY OF THE INVENTION

In accordance with the invention, an alarm system is provided wherein the amplitude and/or phase of an acoustic wave or vibration pattern established in a window pane or other acoustically propagative solid medium is sensed and processed to provide a signal representative of the pattern, and which signal is operative to signify an alarm condition upon its exceedance of a predetermined threshold level. The threshold or reference level is established to represent a quiescent nonalarm condition. The signal derived from the acoustic pattern established in the solid medium changes in response to breakage or disturbance of the medium, which change causes exceedance of the threshold level to provide an alarm condition.

The invention will be described for use with a window pane, but it will be appreciated that the invention is equally applicable for use with other acoustically propagative media wherein a sensible change in an established standing wave pattern can be provided by breakage or disturbance of the media. For example, the invention can be employed for protection of a display case, a security vault or filing cabinet in which a standing wave pattern can be established in one or more walls thereof.

In typical embodiment, the present invention includes a small acoustic transducer cemented or otherwise affixed to the surface of a window pane and which in response to an oscillator input signal propagates an acoustic signal into the pane. Reflections from the boundaries of the pane cause the establishment of a standing wave pattern, the amplitude and/or phase of which are sensed and processed to provide a signal representative of the standing wave pattern. Breakage or disturbance of the pane causes a change in the standing wave pattern and a corresponding change in the signal representative thereof. If the change in the received signal is sufficient to cause exceedance by the signal of a predetermined threshold level, an alarm indication is provided indicative of breakage or disturbance of the pane. The invention can be embodied in a system of sufficiently high sensitivity to cause an alarm upon the unauthorized touching or other non-invasive disturbance of a protected surface, which disturbance can cause a sensible change in the standing wave pattern. The invention may employ two acoustic transducers affixed to a window pane, one for exciting the surface and another for sensing the amplitude and/or phase of the established standing wave pattern. Alternatively, a single transducer can be employed for both excitation and reception by utilization of well-known hybrid transformer techniques to prevent transmission or feedthrough of the excitation signal into the receiver.

DESCRIPTION OF THE DRAWING

The invention will be more fully understood from the following detailed description taken in conjunction with the accompanying drawing in which.

DETAILED DESCRIPTION OF THE INVENTION

Figure 1:
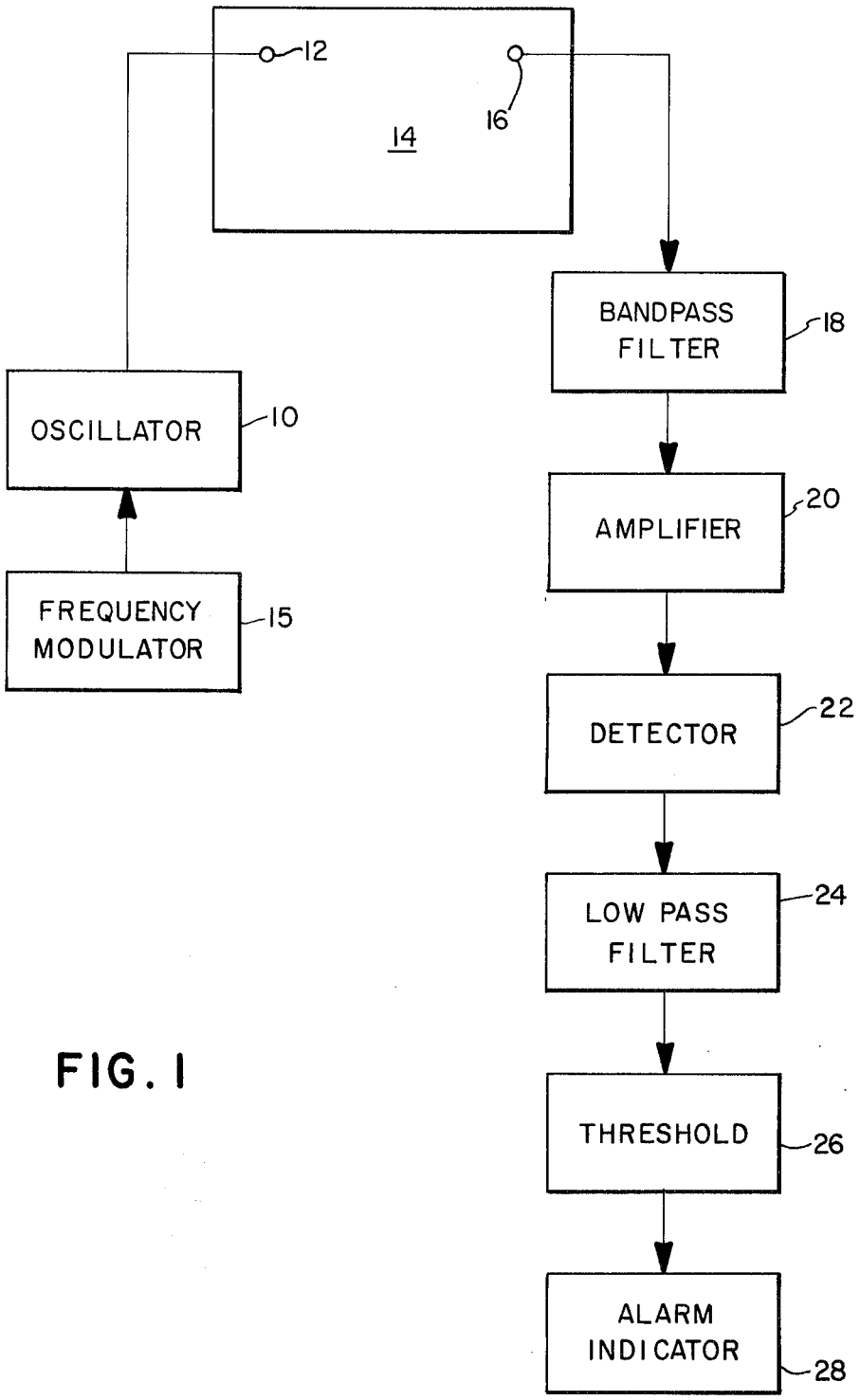
FIG. 1 is a block diagram of an alarm system according to the invention.

An alarm system embodying the invention is illustrated in FIG. 1 and includes an oscillator 10 coupled to and operative to energize a transmitting transducer 12 which is affixed at a selected position to the surface of a window pane 14 so as to excite an acoustic standing wave pattern therein. A frequency modulation source 15 may be coupled to oscillator 10 to provide a frequency modulated oscillator output signal for energization of transducer 12 for purposes to be presently explained. A receiving transducer 16 is affixed at a second selected position on the surface of pane 14 and is operative to sense a standing wave pattern established in the pane and to provide an input signal to a bandpass filter 18 which has a bandwidth for passing only the intended bandwidth of the energizing signal from oscillator 10.

The signal provided by transducer 16 represents the amplitude of the standing wave pattern at a sensing point defined by the position of transducer 16. The bandpass filter rejects signals occasioned by, for example, acoustic noise such as from tapping of the pane. The output of filter 18 is amplified by an amplifier 20, the output of which is applied to an AM detector 22, operative to detect variations in the amplitude of the received signal. The detector output is applied to a low pass filter 24 which is operative to average out short duration amplitude variations which could cause erroneous alarm actuation. The output of filter 24 is applied to a threshold circuit 26 which provides a threshold level defining a quiescent or nonalarm condition. The threshold level is determined in accordance with the average amplitude and phase of the standing wave pattern at the receiving point and from which reference level changes are sensed for alarm actuation. Upon exceedance of the predetermined threshold by the signal from filter 24, an output signal is provided by threshold circuit 26 for actuation of an alarm indicator 28 which may be any suitable visual, aural or other intended output indication of an alarm condition.

The embodiment of FIG. 1 is also operative at a fixed input frequency provided by oscillator 10 without need for frequency modulator 15. In this operative mode, amplitude variations in the standing wave pattern established in pane 14 are sensed by transducer 16, but such variations may be position sensitive thereby requiring precise positioning of receiving transducer 16 to achieve requisite alarm sensitivity. Precise placement of transducer 16 to achieve proper alarm sensitivity is not a critical requirement in the embodiment described above employing a swept energizing signal for transmitting transducer 12. The swept frequency energization of transducer 12 causes a multiple reflection pattern within pane 14 having relatively fine phasing and which minimizes variations in the amplitude of the standing wave pattern as a function of position within the pane. Thus, the position of receiving transducer 16 is not critical.

Figure 2:
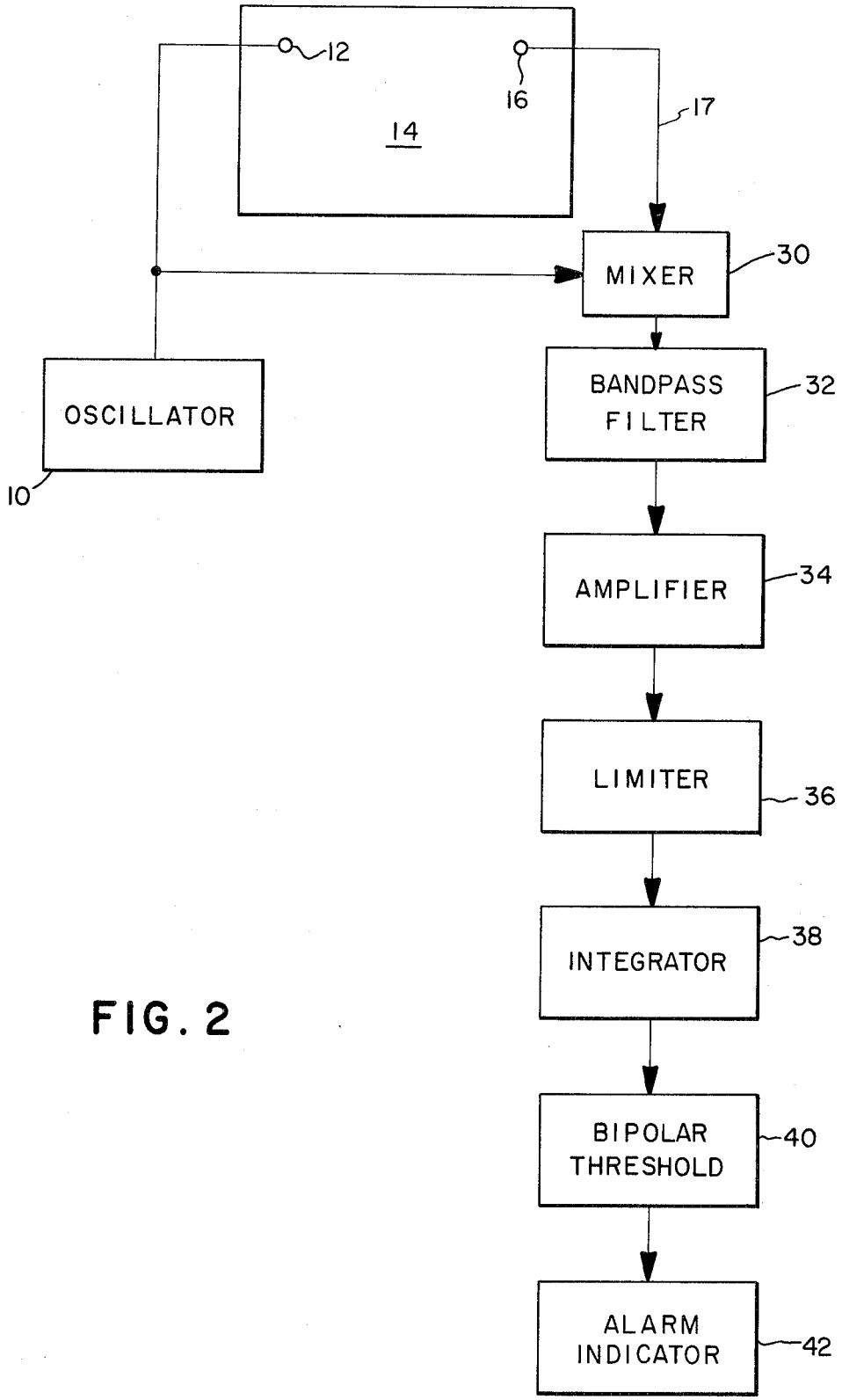
FIG. 2 is a block diagram of another embodiment of an alarm system according to the invention.

An embodiment of the invention is shown in FIG. 2 which is operative to sense the amplitude or phase or both of a standing wave pattern for alarm actuation. Referring to FIG. 2, oscillator 10 is coupled to a transmitting transducer 12 which is affixed to window pane 14 as before. A receiving transducer is also affixed to pane 14 for sensing the standing wave pattern established in pane 14. In this embodiment, transducer 16 is coupled to one input of a mixer 30, the second input of which receives a signal from oscillator 10. The mixer output is coupled to a bandpass filter 32 having a bandwidth operative to pass the baseband signal bandwidth and to reject spurious signal frequencies outside of this bandwidth. The output signal from filter 32 is amplified by amplifier 34 and limited by limiter 36, the output of which is applied to an integrator 38. Limiter 36 prevents relatively large amplitude signals from charging the integrator at an erroneously fast rate; that is, slewing the integrator output too rapidly which could result in a false alarm by erroneous exceedance of the alarm threshold. The output signal from integrator 38 is applied to a bipolar threshold circuit 40, the output of which is coupled to an alarm indicator 42. The bandpass filter 32, amplifier 34, limiter 36 and integrator 38 comprise a signal processor which provides a signal representative of the amplitude and/or phase characteristics of the standing wave pattern established in pane 14 the change in which signal provides an alarm indication by indicator 42 upon exceedance of the threshold level determined by threshold circuit 40.

The threshold circuit 40 includes both positive and negative threshold levels as the signal derived from the sensible pattern established in pane 14 can change either positively or negatively upon alternation of the sensible pattern by disturbance or breakage of the pane. If either of the bipolar circuit threshold levels is exceeded, a net change in amplitude and/or phase of the received standing wave pattern has occurred, indicating breakage or cutting or other disturbance of the window pane, and thus denoting an alarm condition. It should be noted that it is not necessary that the breakage of the glass occur in the area between the two transducers; for example, a break might occur in a lower corner of the window pane and this break will still cause a sensible change in the acoustic standing wave pattern.

Figures 3, 4:
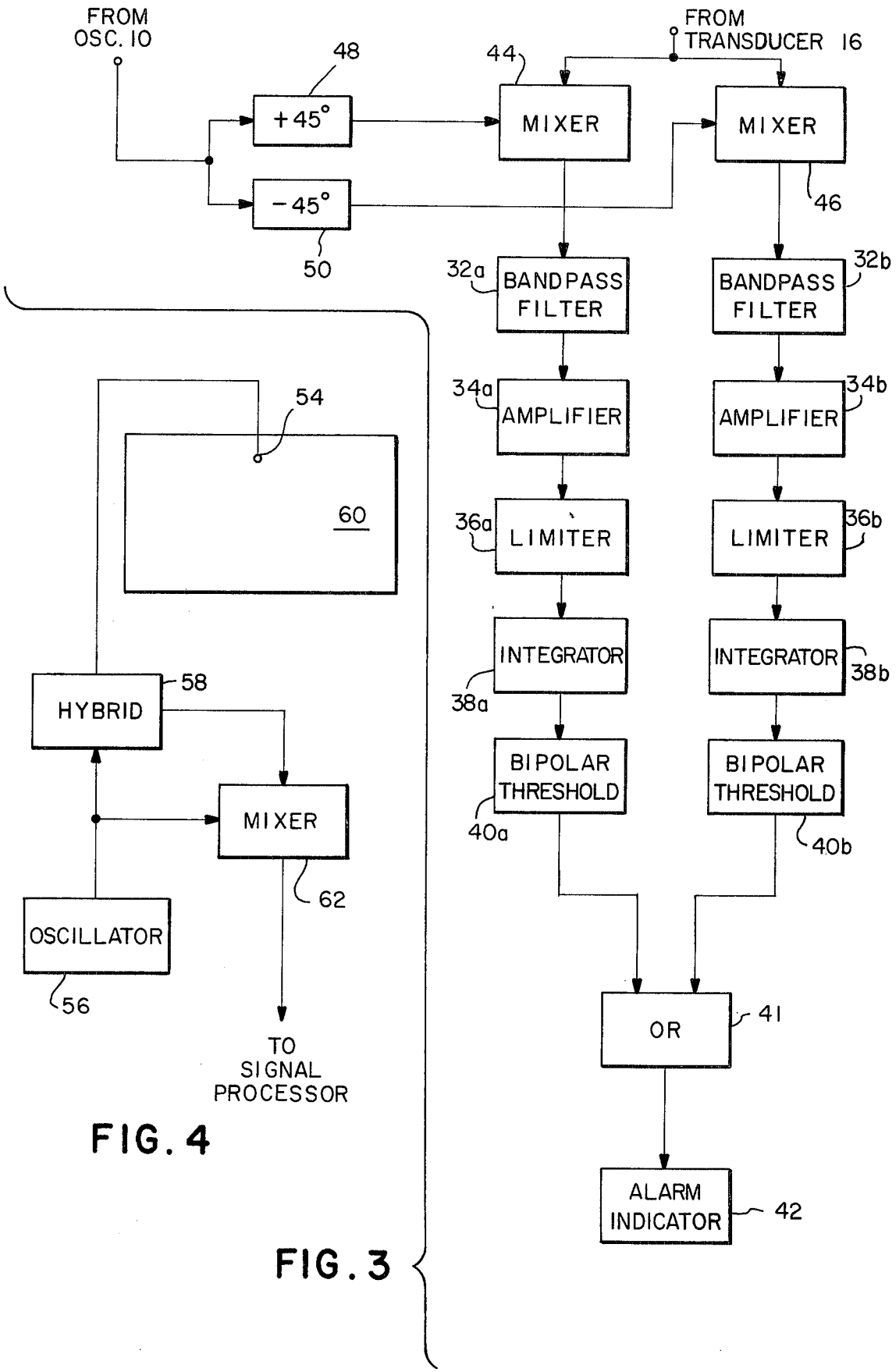
FIG. 3 is a block diagram of a further embodiment of the invention using quadrature processing.
FIG. 4 is a block diagram of a still further embodiment of the invention.

An alternative embodiment of the invention is illustrated in FIG. 3 employing quadrature processing of a sensed pattern signal. The signal from receiving transducer 16 (FIG. 2) is applied to a pair of mixers 44 and 46 which also receive quadrature signals derived from oscillator 10 (FIG. 2) by a phase shifter 48 which introduces a phase lead of 45° to the oscillator signal, and a phase shifter 50 which introduces a phase lag of 45° to the oscillator signal. Quadrature processing is employed to obtain relatively equal receiver sensitivity independent of the phase of the received signal; i.e., the mixer output represents a quadrature view of the received signal vector which allows a given change in amplitude or phase to be sensed independently of the phase position of the resultant vector.

A quadrature processing unit contains two identical channels, each of which can have the same components as in the single channel processing unit shown in FIG. 2. The quadrature processing channels include pairs of bandpass filters **32*a* and 32*b*, amplifier 34*a* and 34*b*, limiters 36*a* and 36*b*, and integrators 38*a* and 38*b*. The quadrature processed signals from the integrators are representative of pattern and are applied to a pair of bipolar threshold circuits 40*a* and 40*b*. The outputs of threshold circuits 40*a* and 40*b* are coupled via an OR gate 41 to a suitable alarm indicator 42. Operation of this embodiment is similar to that of FIG. 2**, except that quadrature processing is provided to produce an output signal for actuation of an alarm upon sensing of a change in the established standing wave pattern exceeding the reference threshold.

It will be appreciated that the alarm system of the invention may be adjusted to detect either breakage or other disturbances of the window pane. The amount and rate of change in the pattern that will cause the system to trigger an alarm may be varied by adjusting the bipolar threshold levels of the threshold circuits or the characteristics of the bandpass filters or both, or by adjusting other portions of the system that will properly affect the system gain.

A further alternative embodiment of the invention is shown in FIG. 4 where a single transducer 54 functions as both the transmitting and the receiving transducer. An oscillator 56 is coupled via a hybrid transformer 58 to transducer 54 which is affixed to a window pane 60. The hydrid 58 operates in well known fashion to couple a received signal to mixer 62 and prevent feedthrough of the oscillator signal to the mixer. Mixer 62 receives an input signal from transducer 54 by way of hybrid 58 and a local oscillator signal from oscillator 56 and provides an output signal representative of the amplitude and/or phase of the sensed standing wave pattern established in pane 60. This signal is then processed as in the embodiment of FIG. 2 to produce an alarm when a requisite change in the wave pattern is sensed. Quadrature processing can also be employed by use of a pair of mixers and quadrature phased local oscillator signals as in FIG. 3.

Figure 5A:
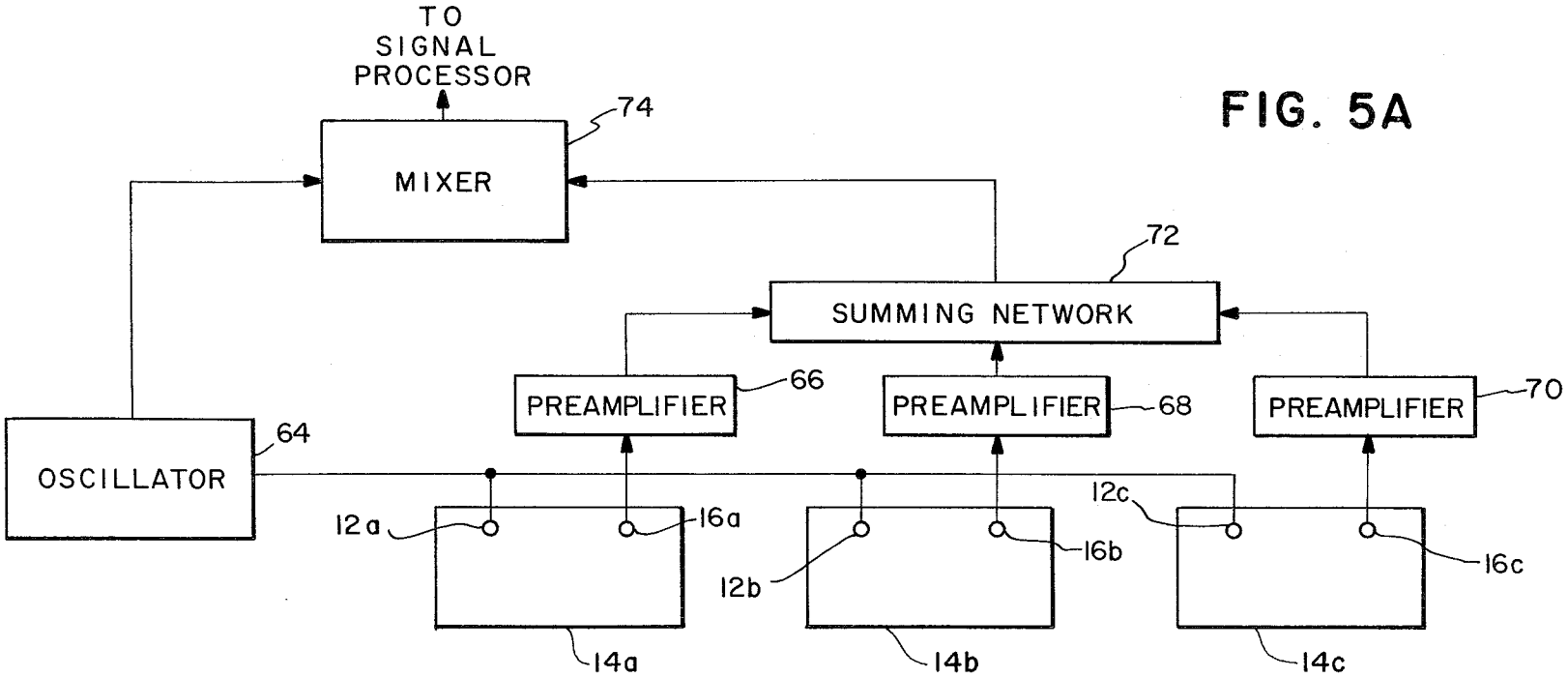
FIG. 5A is a block diagram of an embodiment of the invention for use with an array of window panes.
Figure 5B:
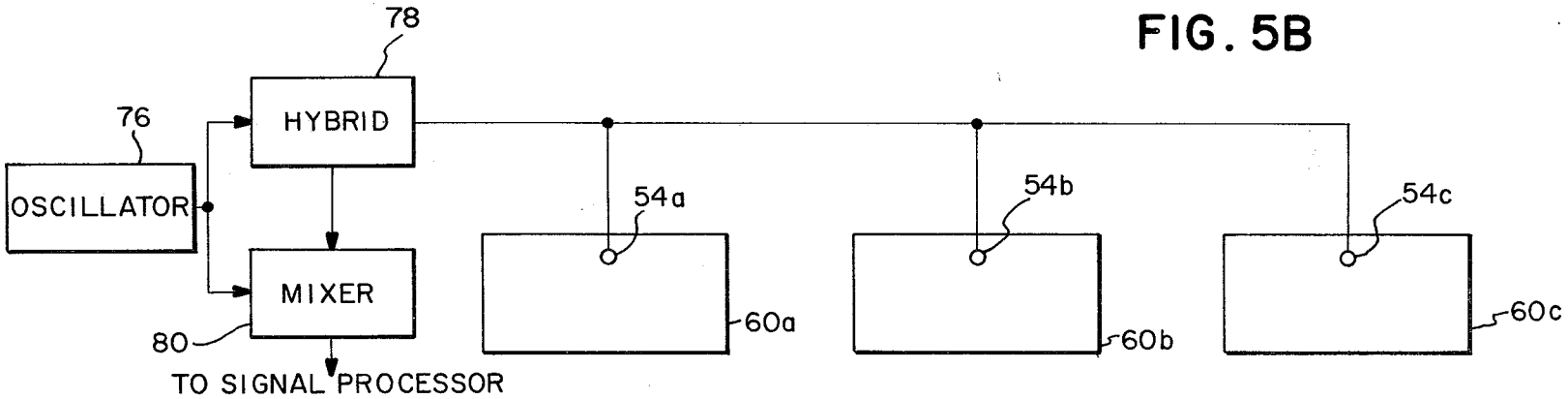
FIG. 5B is a block diagram of another embodiment of the invention for use with an array of window panes.

Further embodiments of the invention are shown in FIGS. 5A and 5B by which multiple window panes or other media can be protected with shared electronic circuitry. In FIG. 5A an oscillator 64 energizes a plurality of transmitting transducers 12*a*, 12*b* and 12*c*, each affixed to the surface of a respective window pane 14*a*, 14*b* and 14*c* to establish a standing wave pattern in each of the panes. Receiving transducers 16*a*, 16*b* and 16*c* are affixed to the respective panes and each is operative to monitor the amplitude and/or phase of the corresponding standing wave patterns. The output from each receiving transducer is coupled to respective preamplifiers 66, 68 and 70, which are in turn coupled to a summing network 72, the output of which is applied to mixer 74 which also receives a signal from oscillator 64. The mixer output is then processed in a manner similar to that shown in FIG. 2.

Illustrated in FIG. 5B is a system for protecting multiple panes utilizing a single transducer on each pane. Oscillator 76 is coupled via hybrid transformer 78 to an array of transducers 54*a*, 54*b* and 54*c* affixed to respective panes 60*a*, 60*b* and 60*c* to establish an acoustic wave pattern in the several panes. Mixer 80 receives an output from hybrid 78 and a local oscillator signal from oscillator 76 and provides an output signal for processing as described above. It will be appreciated that the hybrid arrangement is as in the embodiment of FIG. 4. It will also be appreciated that the embodiments of FIGS. 5A and 5B can employ quadrature processing as in FIG. 3.

From the foregoing, it should be evident that in accordance with the present invention, an alarm system is provided wherein the amplitude and/or phase of an acoustic pattern established in a window pane or other medium is sensed and processed to provide a signal representative of the pattern and which signal actuates an alarm if the sensed change in the pattern exceeds a predetermined threshold value indicating breakage or disturbance of the window pane. The sensitivity of the novel system can be readily adjusted to detect not only pattern changes caused by cutting or breakage of a pane, but changes in the wave pattern caused by touching or pressure on the surface of the pane. Operating at this higher sensitivity, the invention is useful, for example, in museums or stores to indicate disturbance of a showcase containing a valuable artwork or other displayed item.

As discussed above, the invention is not limited to protection of window panes, but is more broadly useful with other acoustically propagative media than glass, such as plastic, metal, concrete and various other materials.

Various modifications and alternative implementations of the invention will occur to those versed in the art without departing from the spirit and true scope of the invention. Accordingly, it is not intended to limit the invention by what has been particularly shown and described, except as indicated in the appended claims.

What is claimed is:

1. An alarm system for use with a plurality of acoustically propagative media comprising:

a plurality of transducers, each affixed to a surface of a respective one of said media;

a single oscillator means for energizing said plurality of transducers to establish a sensible pattern in each of said media;

means for sensing the amplitude and/or phase characteristics of said sensible pattern in each of said media, including:

a plurality of receiving transducers, each affixed to a surface of a respective one of said media, for sensing the sensible pattern at the location on the surface to which it is affixed and for producing a signal representative of the sensed pattern;

a mixer operative in response to the combined output signal and a signal from said oscillator means to provide a mixer output signal; and processing means operative in response to a change in said mixer output signal for producing an intermediate signal representative of the magnitude of such change; and means for providing an output signal representative of an alarm condition when said intermediate signal exceeds a predetermined threshold level.

2. An alarm for use with an acoustically propagative medium comprising:

a transmitting transducer affixed to a surface of said medium;

oscillator means for energizing said transducer to cause establishment of a sensible pattern in said medium;

means for sensing the amplitude and/or phase characteristics of said sensible pattern, including:

a receiving transducer affixed to a surface of said medium for sensing the sensible pattern at the location on the surface to which it is affixed and for producing a signal representative of the sensed pattern;

a mixer operative in response to the signal from said receiving transducer and a signal from said oscillator means to provide a mixer output signal; and processing means operative in response to a change in said mixer output signal for producing an intermediate signal representative of the magnitude of such change;

means for establishing a reference threshold representing a non-alarm condition; and means for providing an output signal representative of an alarm condition upon exceedance by said intermediate signal of said reference threshold.

3. An alarm system according to claim 2 wherein said processing means includes:

a bandpass filter for limiting the bandwidth of said mixer output signal;

means for limiting the signal from said bandpass filter; and means for integrating the limited signal to produce the intermediate signal.

4. An alarm system according to claim 2 and further including:

a second mixer operative in response to the signal from said receiver transducer and a second signal from said oscillator in quadrature phase relationship with the first signal from said oscillator for providing a second mixer output signal; and second processor means operative in response to changes in said second mixer output signal for producing a second intermediate signal representative of the magnitude of such change; and wherein the means for providing an output signal is further operative upon exceedance by said first or second intermediate signals of said reference threshold.

5. An alarm for use with an acoustically propagative medium comprising:

a transducer affixed to a surface of said medium;

oscillator means for energizing said transducer to cause establishment of a sensible pattern in said medium;

means for sensing the amplitude and/or phase characteristics of said sensible pattern, including:

a hybrid transformer for coupling said oscillator means to said transducer and for providing an output signal representative of the sensible pattern sensed by said transducer;

a mixer coupled to said transducer by said hybrid transformer and operative in response to said hybrid transformer output signal and a signal from said oscillator means to provide a mixer output signal representative of said sensible pattern; and processing means operative in response to a change in said mixer output signal for producing an intermediate signal representative of the magnitude of such change;

means for establishing a reference threshold representing a non-alarm condition; and means for providing an output signal representative of an alarm condition upon exceedance by said intermediate signal of said reference threshold.

* * * * *